US005912619A

United States Patent [19]

Vogt

[11] Patent Number: 5,912,619

[45] Date of Patent: Jun. 15, 1999

[54] SECURITY SYSTEM USING OPTICAL SENSORS

[75] Inventor: William R. Vogt, Morris County, N.J.

[73] Assignee: Wells Fargo Alarm Systems, Inc., King of Prussia, Pa.

[21] Appl. No.: 09/001,890

[22] Filed: Dec. 31, 1997

[51] Int. Cl.[6] ..... G08B 13/08

[52] U.S. Cl. ..... 340/545.1; 340/545.3; 340/555; 340/541

[58] Field of Search ..... 340/541, 542, 340/545, 547, 551, 552, 555, 556, 545.1, 545.3, 545.6, 545.7, 545.8

[56] References Cited

U.S. PATENT DOCUMENTS

| | | | |
|---|---|---|---|
| 3,975,723 | 8/1976 | Bowling et al. | 340/547 |
| 4,074,246 | 2/1978 | Conklin et al. | 340/545 |
| 4,210,889 | 7/1980 | Holce | 335/207 |
| 4,507,654 | 3/1985 | Stolarczyk et al. | 340/545 |
| 4,583,082 | 4/1986 | Naylor | 340/545 |
| 4,594,581 | 6/1986 | Matoba | 340/531 |
| 5,434,556 | 7/1995 | Donohoo | 340/547 |
| 5,534,849 | 7/1996 | McDonald et al. | 340/547 |
| 5,644,111 | 7/1997 | Cerny et al. | 187/393 |

*Primary Examiner*—Daniel J. Wu
*Assistant Examiner*—Van T. Trieu
*Attorney, Agent, or Firm*—Polster, Lieder, Woodruff & Lucchesi

[57] ABSTRACT

A security system (40) monitoring displacement between a first, fixed unit (20) and a second, movable unit (21) normally in close proximity to each other. A code generator (51) in the first unit (20) generates a coded electrical signal (Sc) supplied to an optical transducer (24) that converts the signal into an optical signal transmitted at the second unit. A transducer (34) in the second unit receives the transmitted signal, converts it back into an electrical signal now supplied to a code generator (56) in the second unit This generator determines if the electrical signal corresponds to the coded signal. If so, this second code generator generates a second coded electrical signal which is supplied to a transducer (35) in the second unit that converts the signal into an optical signal transmitted back toward the first unit. A transducer (28) in the first unit receives this reply signal and converts it back into an electrical signal. The first code generator now determines if the reply signal supplied corresponds to the second coded signal. Failure of the first unit to either receive the return signals or of the fist code generator to determine the reply signal corresponds to the second coded signal indicates either the units are no longer in close proximity; or, someone is trying to compromise the security system. Either condition constitutes an alarm condition for which an alarm is produced.

7 Claims, 6 Drawing Sheets

SECURITY SYSTEM USING OPTICAL SENSORS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a system for monitoring the relative displacement between one object and another object normally located adjacent to, or in close proximity of, the one object. In particular, a security system uses a position sensor employing energy in the frequency range of light, to monitor the open or closed position of a door or window, or the movement of an object such as an attache case or the like from a stored position, or a boat from a slip. The security system can also employ dual technologies such as magnetic sensing and optical sensing.

Conventionally, security systems monitoring various possible points of entry into a facility used different types of sensors to determine whether, for example, a door is positioned adjacent its associated frame (i.e., closed), or whether the movable portion of a window is adjacent its frame or a fixed portion of the window unit. Generally, these security systems use a magnetic sensor employing a reed switch or the like, and a magnet. The magnet is positioned on the door or movable portion of the window, and the reed switch on the door or window frame adjacent the magnet. When the door or window was properly positioned (i.e., closed), the strength of the magnetic field produced by the magnet is sufficient to keep the reed switch closed. When, however, the door or movable portion of the window is moved (displaced) from its closed position, the strength of the magnetic field at the location of the reed switch decreases to a level where the reed switch now opens. Opening of the switch results in a signal being sent to a monitoring device signifying the changed status (i.e., opening) of the door or window. Essentially, these security or monitoring systems detect the presence, strength, and polarity of a magnetic field as an indication that a static condition (door closed) is present.

Various attempts have been made to defeat these systems. One approach in doing so has been to introduce a second magnet next to the reed switch to "fool" the switch when the door or window is displaced. By doing so, the security system is tricked into indicating that the door or window is still closed; although in reality, the door or window has been opened to permit unauthorized entry. To thwart these attempts, improvements have been made to the security systems. One such improvement is the use of multiple magnets per sensor (reed switch), and multiple sensor/magnet combinations, so that merely altering the magnetic field by locating another magnet adjacent the switch is not sufficient to keep the switch from triggering a monitor when the door or window is opened. Regardless of the nuances employed in the different ways by which magnetic sensing based security systems have been upgraded, it has nonetheless been found that some magnet/switch combinations can still be compromised; while others have proven to be so unstable that they cannot be relied upon in system usage. It is therefore desirable to have a security system and system sensor which is not defeatable so that the facility's security cannot be compromised.

BRIEF SUMMARY OF THE INVENTION

Among the several objects of the present invention may be noted the provision of a security system for monitoring a premise, for example, doors and windows by which the premise can be entered by unauthorized individuals, as well as monitoring an attache case or the like to detect unauthorized movement of the case from a storage location;

- the provision of such security system which does not rely upon magnets and reed switches or the like to monitor a door, window, or other object and which is therefore not susceptible to being compromised by devices employing electromagnetic radiation and/or reed switches which otherwise provide false status information about the door, window, or object;
- the provision of such a security system to employ optical sensors to monitor the position of doors, windows, or other objects and to reliably provide a suitable indication as to whether a door or window is open or closed, or if an object is moved from a particular location;
- the provision of such a security system which is not susceptible to defeat by unauthorized persons trying to compromise the position sensors used by the system thus for the system to be not only much more suitable, but also more stable than previous security systems using magnets and reed switches or the like;
- the provision of such optical position sensors which operate in the infrared portion of the light spectrum;
- the provision of such a security system to monitor the presence, strength, and accuracy of a communication transmitted from one location to another with a response being received back at the first location;
- the provision of such a security system in which information including encrypted information is transmitted back and forth between a sensing element located in a reference position and a sensing element movable relative to the reference location, and the system is sensitive to i) the receipt or absence of a signal transmitted from one sensor to another, or ii) the amplitude of a received signal, or iii) the data content of information transmitted from one location and received at the other located, to trigger an alarm;
- the provision of such a security system to transmit information from one sensor to the other and to monitor for any or all of the above stated conditions to determine the status of the door, window, or object;
- the provision of such optical position sensors which can be either used as original equipment in new security systems or retrofitted into existing systems;
- the provision of such a security system to further combine magnetic field technology and optical system technology in implementing a sensor used in the system; and,
- the provision of such a security system having an enhanced monitoring capability and which provides users the absolute highest level of assurance possible that their premises are adequately protected.

In accordance with the invention, generally stated, a security system indicates the displacement between a first, reference unit and a second unit positioned adjacent the first unit. The system comprises a signal generator and a first transducer in the reference unit coupled to the signal generator. Signals produced by the generator are transmitted to the first transducer which generates a transmission signal in response thereto. A receiver transducer is also provided in the reference unit to receive the transmitted signal from the first transducer. A reflection arrangement is located in the second unit and is positioned to transmit at least a portion of the transmitted signal from the first transducer to the second transducer; this transmission occurring when the second unit is in a predetermined reference position adjacent the reference unit. A detector coupled to the second transducer recognizes reception of the reflected portion of the transmitted signal by the second transducer, when the second unit is in its reference position. A status indicator is coupled to the detector to provide a status indication as to the proximity of the first and second units. The first unit may, for example, be mounted on a door frame or window frame, and the second unit on the door or window. Further, the reflection unit can be replaced by a receiver/transmitter which receives a transmission from the first transducer and sends back to the second transducer another, separate transmission. In this latter embodiment, the security system causes information including encrypted information to be transmitted back and forth between the two units; and the system is sensitive to the receipt or absence of a signal transmitted from one unit to another, the amplitude of a received signal, and the data content of information transmitted between the two units to determine if all is well, or to trigger an alarm. Other objects and features will be in part apparent and in part pointed out hereinafter.

BRIEF DESCRIPTION OF THE SEVERAL VIEWS OF THE DRAWINGS

In the several figures of the drawings, like reference numerals designate like components, and in those drawings.

Corresponding reference characters indicate corresponding parts throughout the drawings.

DETAILED DESCRIPTION OF THE INVENTION

Figure 1:
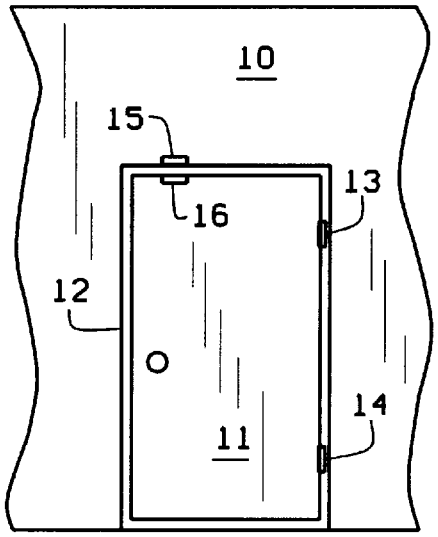
FIG. 1 is a simplified illustration of a door and door frame for use in understanding the various embodiments of the invention.

Referring to the drawings, in FIG. 1 a portion of a building 10 is shown in which a door 11 is installed. The door is installed with a door frame 12 and the door is attached to its frame by a pair of hinges 13, 14. A reed switch 15 is attached to the door frame, and a magnet 16 is affixed to the door. When the door is closed, the magnetic field produced by magnet 16 holds reed switch 15 in a closed position. However, when door 11 is opened, the magnet is moved away from the reed switch, and the strength of the magnetic field in the area of the reed switch decreases. When this occurs, reed switch 15 opens to signal the door-open condition. While not shown, it will be understood that a similar arrangement also works for a window with the reed switch being attached to the window frame and the magnet to the movable portion of the window. The reed switch/magnet combination is a conventional setup for indicating door or window opening in previous security systems.

Figure 2B:
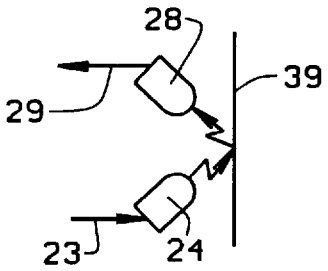
FIG. 2B is a partial block diagram showing a modification to the security system of FIG. 2A.
Figure 2A:
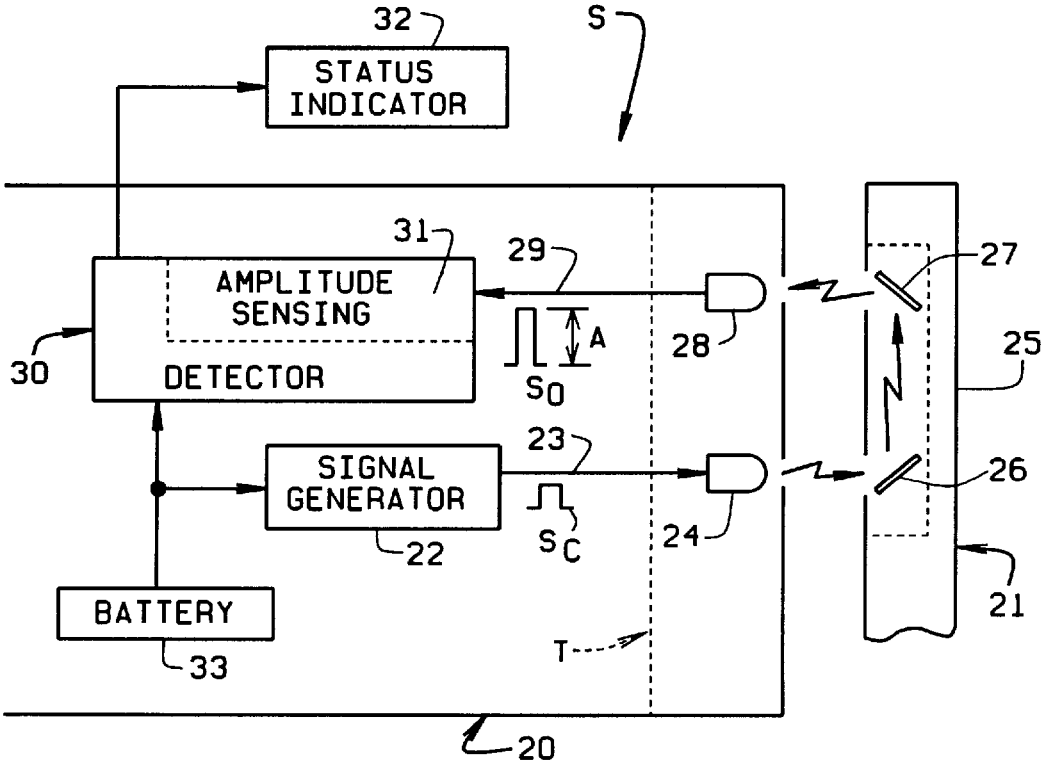
FIG. 2A is a simplified block diagram of a first embodiment of the security system of the present invention.

FIG. 2A illustrates part of a security system S constructed in accordance with the present invention. Among its many features, security system S indicates the displacement between a first (reference) unit 20, which is preferably mounted on a door frame or window frame, and a second unit 21 which is positioned adjacent unit 20. The second unit may be attached to a door, the movable portion of a window, or some other element by which the second unit is movable with respect to the first unit. It will be understood that the first and second units may both be movable, so there is relative movement between the two units then when either is moved from one position to another. Included in first unit 20 is a signal generator 22 which is coupled over a line 23 to a first transducer 24 of a transducer means T. Transducer 24, in the preferred embodiment, is a light source; for example, an infra-red light-emitting diode (LED) which generates a transmission signal (infra-red light) when energized by a command signal Sc from signal generator 22. A reflector 25 is included in second unit 21 and includes first and second mirrors 26, 27 which are installed in unit 21 so light from a predetermined direction (as indicated by the wavy arrow in FIG. 2A) impinging upon one of the mirrors is directed at the other mirror. The mirrors are oriented in FIG. 2A so that light impinging upon mirror 26 is reflected at a 90° angle toward mirror 27, and light impinging upon mirror 27 is also reflected at a 90° angle. It will be understood that depending upon a particular installation, these angles could be changed.

A second transducer 28 of transducer means T is, for example, a light receiver such as an infra-red sensor unit, and is included in reference unit 20 to receive signals transmitted by transducer 24. When signal generator 22 energizes first transducer 24, the transducer emits an infrared signal which is directed at mirror 26 of reflector 25. A portion of this transmitted signal is reflected by mirror 26 toward mirror 27 and (as shown by the other wavy arrow in FIG. 2A) back toward second transducer 28. This transmission and reception of infrared energy will only occur if second unit 21 is in a predetermined reference position (as shown in FIG. 2A) adjacent first unit 20. A detector 30 included in unit 20 detects an output signal So generated by transducer 28 over line 29 in response to receipt of a reflected transmission from transducer 24. It will be understood that unit 20 may comprise a single housing or enclosure or that the components may be housed in multiple enclosures.

Detector 30 includes amplitude detection circuitry 31. The amplitude A of the signal So generated by transducer 28 is a function of the amount of energy received by the transducer. If unit 21 is in its predetermined position as shown in FIG. 2A, the amount of energy received by transducer 28 is a maximum and the amplitude of the signal generated by the transducer is a peak value. As the door or window is moved, so second unit 21 is moved away from its reference position, the amount of energy received by transducer 28 is reduced. The amplitude of the resulting signal generated by second transducer 28 is correspondingly less than the peak value. Amplitude detection circuitry 31 senses the amplitude level of the output signal So from the transducer and compares this level with a predetermined threshold value. When the output signal amplitude is within an acceptable range of values, detector 30 provides an appropriate output to a status indicator 32 of the security system. If the signal amplitude falls outside this range, detector 30 provides an appropriate output of this condition to status indicator 32 as well. Finally, it will be understood that while second unit 21 is a passive unit, first unit 20 requires a source of power such as is supplied by a battery 33 to both signal generator 22 and detector 30.

In FIG. 2B, a modification of the arrangement of FIG. 2A is shown. Here, reflector 25 with its canted mirrors 26, 27, is replaced by a single, flat plate mirror 39. Now, transducers 24 and 28 are each aligned at 45° angles with respect to this mirror so that the infrared light waves emitted by transducer 24 are reflected off mirror 39 directly at transducer receiver 28 through the resulting 90° angle. While this embodiment replaces the two mirror arrangement with a single mirror, it will be understood that other mirror arrangements can be used without departing from the scope of the invention. For example, instead of a flat plate, mirror 39 can be a convex or convex mirror. For a convex mirror, the alignment of the transducers is the same as shown in FIG. 2B. Again, it will be understood that depending upon a particular installation, these angles could be changed. It will be noted that adjusting the angles can be used to set the distance between the objects.

Figures 3, 4:
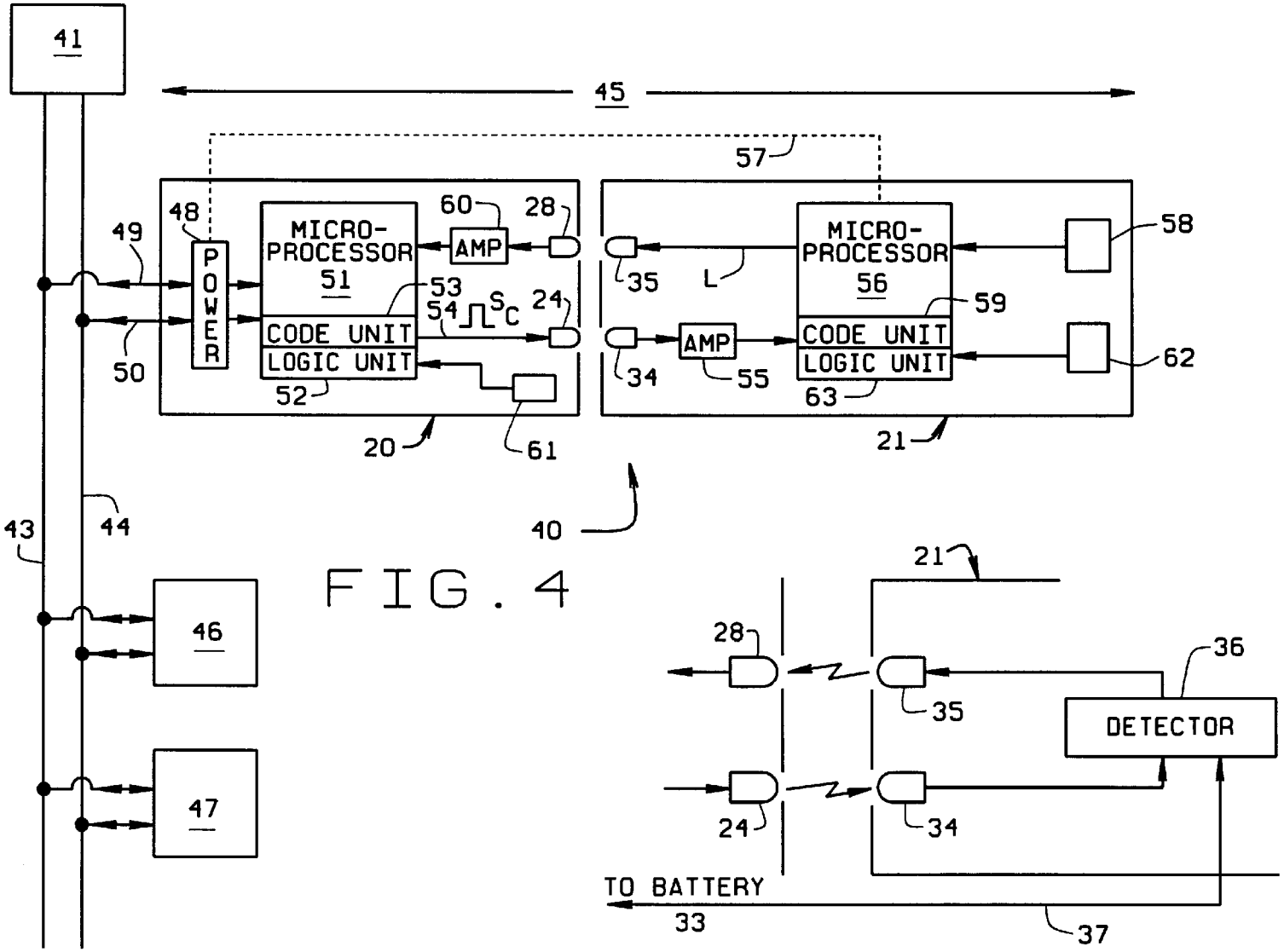
FIG. 3 is another partial block diagram showing another modification to the security system.
FIG. 4 is a block diagram of a preferred embodiment of the security system of the invention.

In FIG. 3, another embodiment of the security system involves replacement of reflector 25 by another pair of transducers 34, 35. Transducer 34 comprises an infrared receiver which detects the infrared light emitted by transducer 24 in response to a command signal from generator 22. The output of transducer 34 is provided to a detector/generator 36 which may also be connected to a power source through a power line 37; or which, may have its own independent power source such as a battery (not shown). Detector 36, in response to receipt of an input from transducer 34, generates a signal which is supplied to transducer 35; which, like transducer 24, is an infiared LED. The infrared light emitted by transducer 35 is now received by transducer 28 which responds thereto by generating an output signal So as before.

With respect to the features of security system S, as shown and described in FIGS. 2A, 2B, and 3, it is important to understand that, in addition to being able to provide a status indication as to whether a door or window is open or closed, the system is also difficult to trick. Whereas with reed switches and magnets, it may have been possible to fool the security system using other magnets into thinking a door or window was closed when it was actually open, use of the infrared optical sensors incorporated in units 20, 21 cannot be readily decoyed into providing an incorrect status indication. Signal generator 22, for example, can provide a complex code of command signals to transducer 24. The signal generator can vary the signal scheme so the same light emission pattern produced by the transducer at one instant is not the same as that produced at another instant. In the embodiment of FIG. 3, use of the detector/generator 36 adds an additional complicating element for one trying to fool the system. This is because the signal pattern commanded by detector 36 of transducer 35 does not have to be the same pattern commanded by generator 22, produced by transducer 24, received by transducer 34, and processed by detector 36. Thus someone trying to defeat the security system will have to try to uncover the coding scheme of at least one, and possibly two, different signal generators; in addition to providing signals of the correct amplitudes. And, these coding schemes can be variable over time, and not a function of one another.

Referring to FIG. 4, a preferred embodiment of the invention includes a security system indicated generally 40. A pair of conductors 43, 44 provide a path for electrical signals and power from a central controller 41 to a plurality of security locations or points 45, 46, 47. Point 45 represents, for example, a door/door frame combination such as previously described. At this location, a first unit 20 is mounted or attached to the fixed part of the assembly (the door frame), and a second unit 21 is attached to the movable portion of the assembly (the door).

Unit 20 includes a power supply 48 which is connected to conductors 43, 44 via conductors 49, 50. Or, the power supply can be a battery which does not need connection to the conductors but rather independently supplies power to unit 20. Unit 20 includes a microprocessor 51 which includes a logic unit 52 and a code unit 53. The output of the microprocessor is a command signal Sc sent over a line 54 to transducer 24. Transducer 24 generates infrared light signals as previously discussed, which are coded in a predetermined manner as determined by code unit 53 of microprocessor 51 for the purposes also previously discussed. These infrared light transmissions are received by transducer 34 located in unit 21. The output signal from transducer 34 is supplied through a signal amplifier 55 to a microprocessor 56 in unit 21. This second microprocessor is either powered by power supply 48 via the dashed line connection 57 shown in FIG. 4, or the microprocessor is separately powered by a battery 58. If powered from power supply 48, the electrical wires are run through the door frame near a hinge since this comprises the minimum distance between the door and door frame.

The amplified signal from transducer 34 is received and processed by microprocessor 56. This microprocessor includes a code unit 59 which now evaluates this signal to determine if the received coded input to the microprocessor matches that transmitted by microprocessor 51 through transducer 24. If it does, then code unit 59 generates a coded response signal which is supplied by microprocessor 56, through a line L, to transducer 35 which emits an infrared signal from unit 21 toward transducer 28 in unit 20. The signal received by transducer 28 is amplified by an amplifier 60 and provided as an input to microprocessor 51. The microprocessor uses its code unit 53 to ascertain if the received, coded response from unit 21 is the correct response.

At both microprocessor 56 (for the transmitted coded signal) and microprocessor 51 (for the return response), the received signals are processed with respect to both the content (i.e., coding) of the signal, and the signal amplitude. There are five conditions which are monitored. Of these, four may produce a possible alarm condition resulting in an alarm signal being sent from unit 20 over conductors 43, 44 to central controller 41. Transmission of alarm signals is as taught in U.S. Pat. Nos. 4,394,655; 4,470,047 and 4,507,652, the teachings of which are incorporated herein by reference. The only condition which will not trigger an alarm is one in which the both the contents of the signal are correct, and the signal amplitude falls within a predetermined range of acceptable values. With respect to the other possible conditions, if the signal amplitude is too great (above the range) then the signal has possibly been generated by a substitute unit in order to trick the security system. If the signal is too weak, it signifies the door or window has been opened. If there is no signal, it indicates the door is substantially open or possible trouble within the system. If the signal data is incorrect, it signifies that again someone is trying to trick the system.

Figure 5:
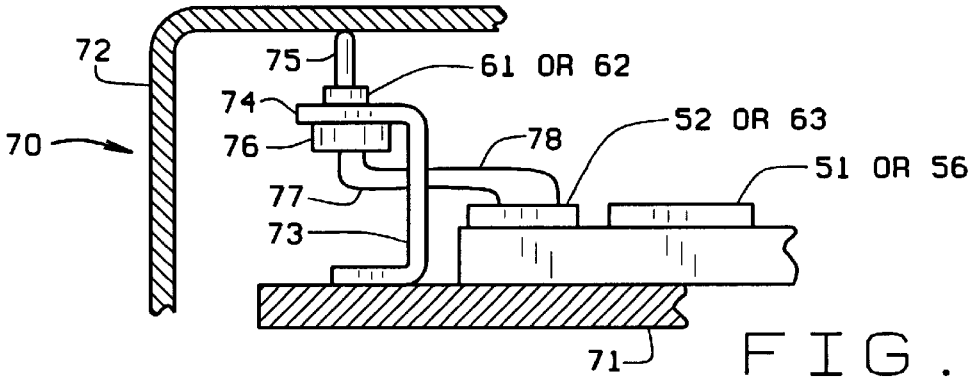
FIG. 5 is a partial, broken-away view illustrating the placement and operation of a tamper switch of the security system.
Figure 6:
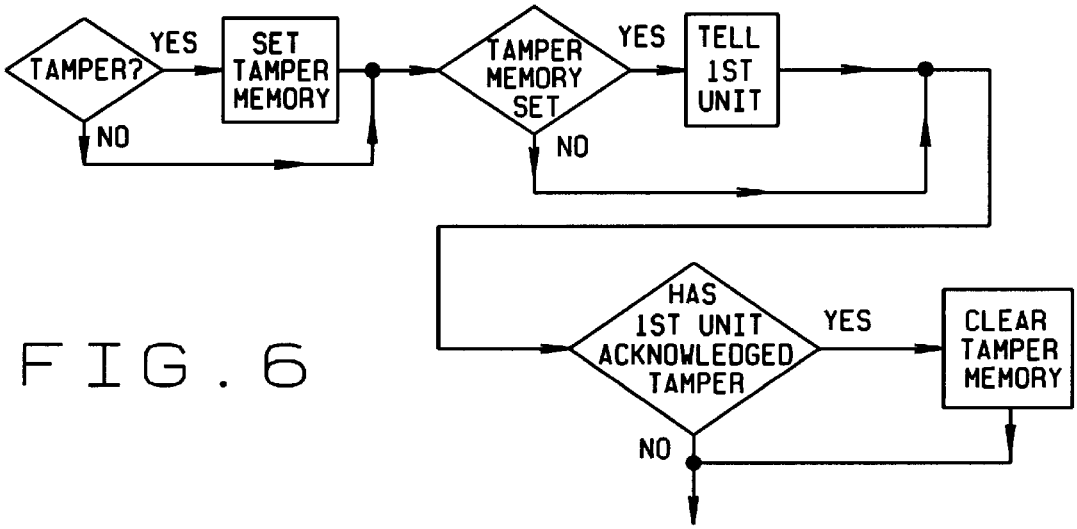
FIG. 6 is a graphical illustration useful in understanding operation of the tamper switch.

A tamper switch 61 is connected in unit 20, and another tamper switch 62 is connected in unit 21. Switch 61 connects to logic unit 52 of microprocessor 51, and switch 62 to a logic unit 63 of microprocessor 56. The tamper switches are identical in construction and one of the switches is shown in more detail in FIG. 5. The tamper switch provides an output electrical signal in response to a mechanical displacement. Each unit 20 and 21 is housed in an enclosure 70 having a base 71 and cover 72. A bracket 73 is mounted to the base 71 of each enclosure. The bracket has a bracket arm 74 in which the tamper switch is installed. A spring loaded plunger 75 of the switch extends upwardly from a switch housing 76, and the plunger is depressed when cover 72 is fitted over the base enclosing the elements of the respective units. Electrical connection is made between the switch and the respective logic unit of the microprocessors by conductors 77, 78. After installation of the respective units, removal of the cover of either unit will cause switch 61 or 62 to produce an electrical output signal to the associated logic unit of the respective microprocessor. The generation of this signal does not necessarily trigger an alarm, just as the occurrence of one of the four conditions described above does not necessarily trigger an alarm. Rather, microprocessors 51 and 56 are programmed to store all occurrences in their memory, whether they are one of the four anomalous conditions or the triggering of the tamper switch. Central controller 41 periodically polls each of the points on a loop including points 45, 46, and 47. Whenever microprocessor 51 receives a poll, it communicates to the central controller that information representing what has occurred since the last poll. As shown in the simplified flow diagram of FIG. 6, if there is a tamper of unit 21, a tamper memory 79 incorporated in microprocessor 56 records this event (i.e., the memory is set) and that information is communicated to microprocessor 51. If unit 20 experiences a tamper, that event is recorded in a memory 79 of microprocessor 51. When unit 20 is polled by central controller 41, microprocessor 51 communicates to the controller if there has been a tamper or has not been a tamper, and if a tamper, with which unit. If there has been a tamper, the controller acknowledges the event, after which the appropriate memory 79 is cleared.

Figure 7:
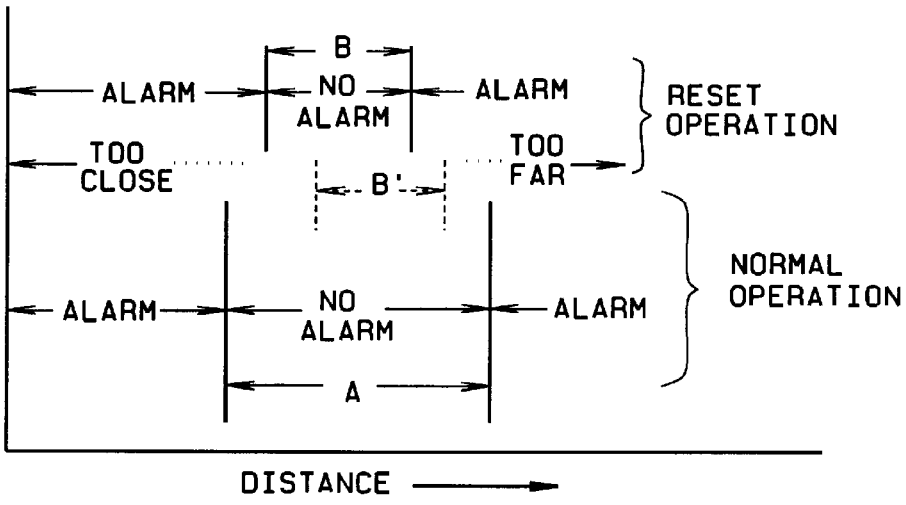
FIG. 7 illustrates respective operational ranges of optical sensors employed in the security system to prevent false alarms.

Referring to FIG. 7, security system 40 and the units 20, 21 incorporate a "hysteresis" feature to prevent intermittent false alarms when units 20, 21 are moved small distances with respect to each other. Under normal conditions, an alarm threshold is established for a predetermined distance of separation. This is the distance A shown in FIG. 7. Note that there is an alarm given if the distance between door 11 and door frame 12, for example, is either too close, and too far. Those skilled in the art will appreciate that "too close" although not necessary, adds an additional level of security. The normal distance of separation between units 20, 21 when door 11 is closed is a distance that falls within the range A, and for this situation no alarm is given. This distance is, for example, ½". In accordance with the invention, whenever an alarm condition exists, the software incorporated in the security system adjusts the alarm threshold to a narrower range indicated B in FIG. 7. This range is, for example, ¼". A predetermined delay may be incorporated in the system to stabilize its operation; this delay being, for example, approximately three seconds. If the system determines that the units 20, 21 remain in the narrow no-alarm range B for a predetermined delay period, then the alarm threshold is automatically expanded to the wider no-alarm band A. The delay period ensures that if the door bounces when first closed, the security system will not set up as normal unless door 11 and frame 12 spacing remain within range B until the expiration of the delay period. The use of this dual range feature provides a certain margin for error (i.e., door movement) without an alarm resulting. This prevents the issuance of false alarms, because the door must be closed to within the narrow range B before the system will set up as normal. At door closing time, the door must be positioned within the narrow no-alarm range B, and not in a position on the verge of an alarm condition. Note that while both range A and range B are centered about the same distance of separation, this does not have to necessarily be so. Rather, range B can be skewed to one side of range A or the other as indicated by B' in FIG. 7.

Figure 8:
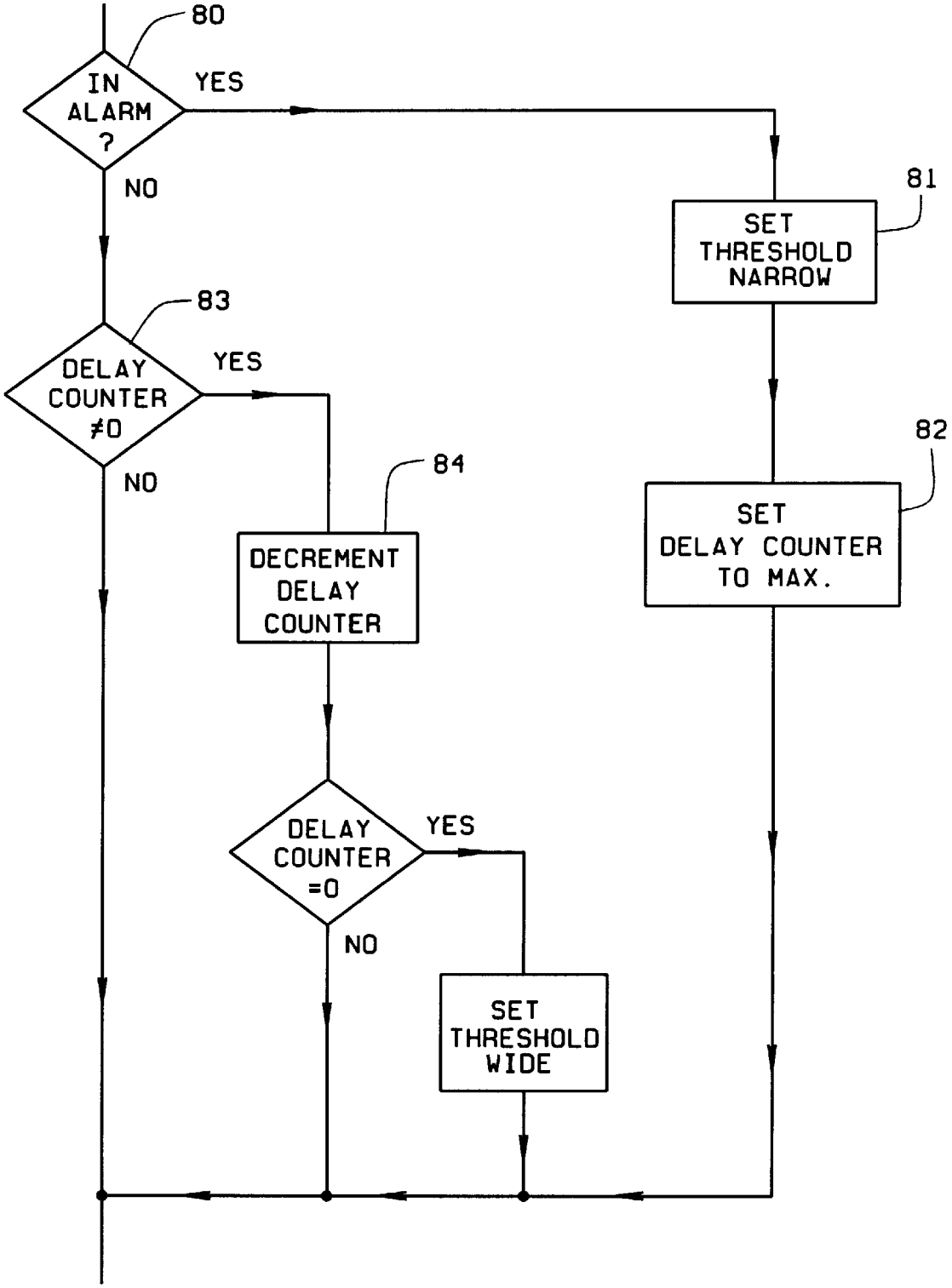
FIG. 8 is a flow diagram illustrating how the security system alarm threshold is adjustable to prevent false alarms.

FIG. 8 represents a flow diagram for the operational sequence described with respect to FIG. 7. If the system is in alarm as indicated at 80, then the alarm threshold is set at the narrower threshold of range B as indicated at 81. In addition, a delay counter (not shown) is set for the full delay period as indicated at 82. If the system is not in alarm, the status of the delay counter is checked as indicated at 83. If the delay count value is zero, then no action occurs. If the delay count value is not zero, then the counter is now decremented as indicated at 84. At 85, the status of the delay counter is again checked. If it is not at zero, then the narrower range B remains in effect. However, as indicated at 86, if the counter value has reached zero, then the range is expanded to range A.

Figure 9A:
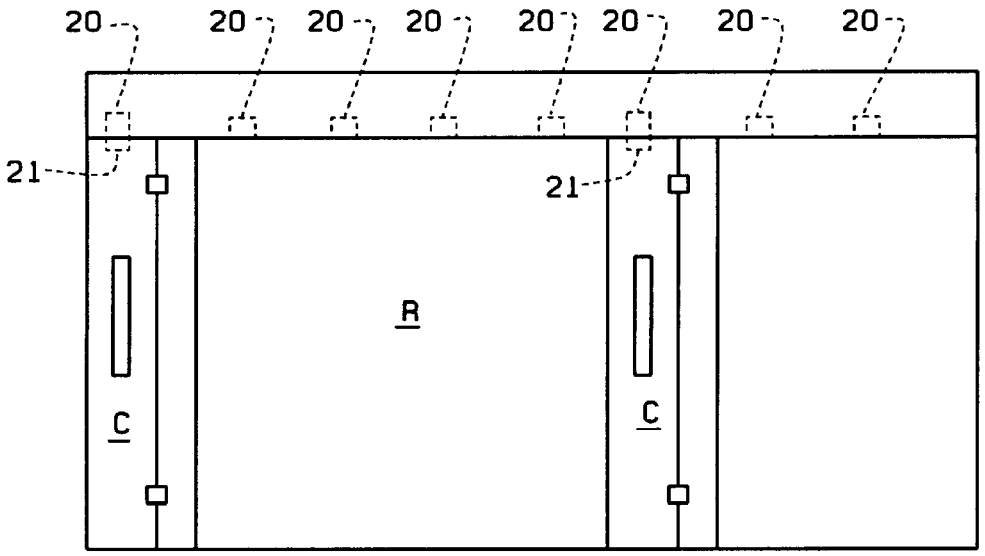
FIG. 9A is a representation of the system used to monitor the presence of an attache case or the like at a storage location.
Figure 9B:
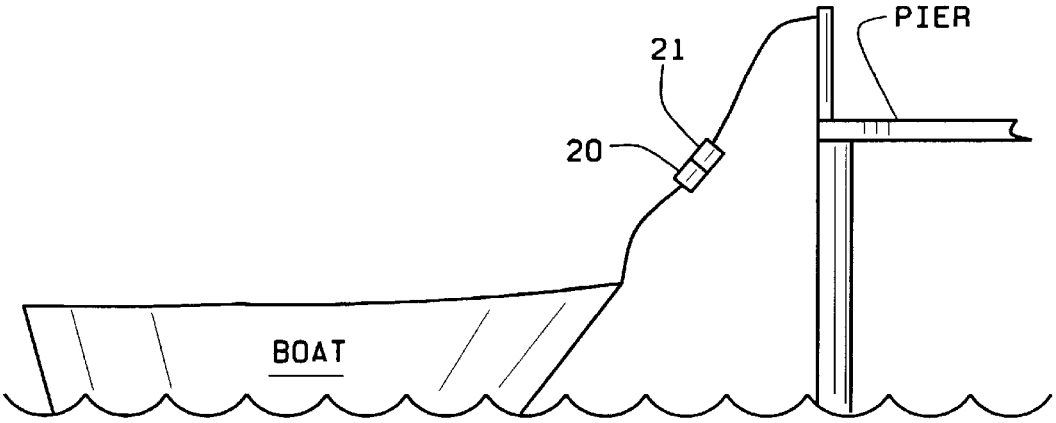
FIG. 9B is a similar representation for a boat.

While the foregoing discussion has been with respect to the security of a premise, the security system of the present invention has a broad range of applications. For example, in FIG. 9A, an attache case C which may contain confidential documents is set in a storage rack R. A plurality of spaced units 20 are built into the rack. A unit 21 is incorporated into the attache case. When the case is set in place, the security system is operational as previously described. Now, if someone moves the attache case from its storage position, this will be monitored in accordance with the previously described system operation and an alarm will be sounded. This illustration is merely exemplary of how the security system can be adapted to other than monitoring a premise. In addition to the application shown in FIG. 9A, a similar arrangement could be used, for example, to monitor boats moored in a slip as illustrated in FIG. 9B.

Figure 10:
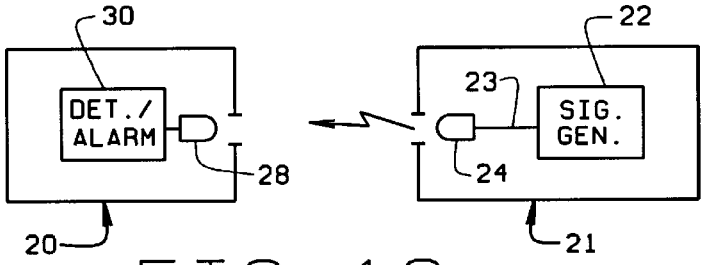
FIG. 10 is a simplified block diagram of a single path version of the system.
Figure 11:
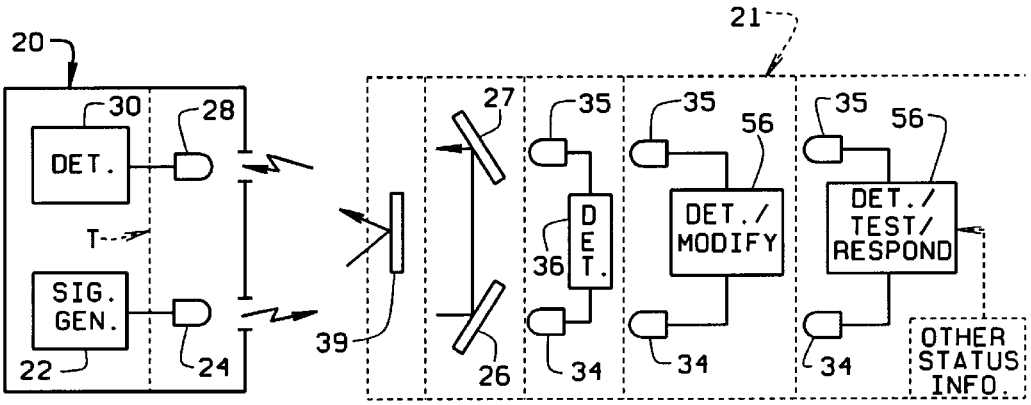
FIG. 11 is a simplified block diagram of various ways in which the security system of the present invention can be implemented.

FIGS. 10 and 11 illustrate both the simplicity and complexity achievable with the security system of the present invention and recapitulate the various above described embodiments. As shown in FIG. 10, the basic system uses a signal generator 22 in a unit 21 which activates a transducer 24 to transmit an infrared signal toward a unit 20. A receiver transducer 28 in unit 20 provides an output to a detector/alarm unit 30 in response to received infrared light transmissions. The detector is responsive to the presence of a received transmission to determine the amplitude of the received signal; or if the transmission is a data transmission, whether or not what is received corresponds with what was expected. If no transmission is received, if the amplitude of the received signal falls outside a predetermined range, or if what is received does not correspond to what was expected, an alarm may be triggered. Those skilled in the art will recognize that the embodiment shown in FIG. 10 is somewhat analogous to the reed switch/magnet sensor used in conventional security systems in that the embodiment of FIG. 10 is a unidirectional sensing configuration. However, this embodiment represents a marked improvement over the reed switch/magnet combination for the reasons discussed above.

In FIG. 11, the five different embodiments of the security system described above are recapitulated. In each instance, the configuration of unit 20 is generally the same and includes the transducer means T with the transmitting transducer 24 and receiving transducer 28, signal generator 22, and detector 30. The other unit 21 may have any of a number of different configurations including a single reflective mirror 39 or multiple mirrors 26, 27 by which a transmission from unit 20 is reflected back to it. Alternate embodiments include a receiving transducer 34 and transmitting transducer 35 which are coupled with a detector 36 which detects a data transmission and returns the same data as a response, or a microprocessor 56 which allows detection of a data transmission and modifies the data which is transmitted as a response, or performs tests on the received data before transmitting the same or different data as a response. In this latter mode, and as another alternative embodiment, other status information can be incorporated in the reply sent from unit 21 to unit 20.

Figure 12:
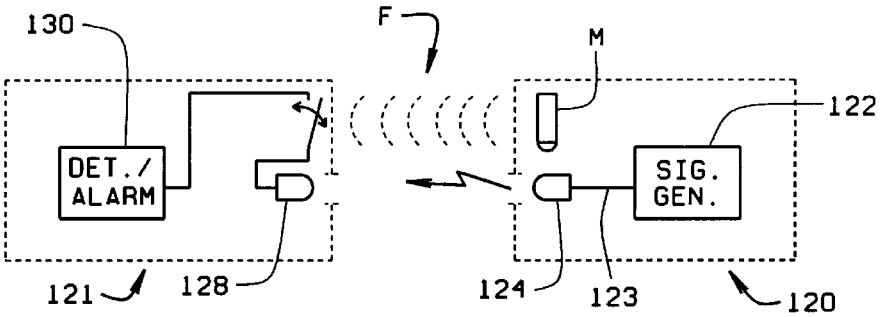
FIG. 12 illustrates a dual technology approach employing both magnetic and optical components in a sensor used in the security system.

The merits and short-comings of using a magnetic field for movement sensing are well known by those skilled in the art. The advantages of using infra-red light and data for movement sensing have been described hereinabove. By utilizing both technologies together in the same enclosure(s) can add an additional level of security to the system. Regardless of how secure either system normally is alone, a dual technology sensor significantly magnifies the complexity involved for someone attempting to compromise the system. In order to defeat such a combinational system the intended intruder would have to defeat both technologies simultaneously in order to thwart the system. Referring to FIG. 12, the security system now includes a first unit 120 having a signal generator 122 transmitting coded signals over line 123 to an optical transducer 124. A magnet M is also installed in unit 120 and produces a magnetic field F as is well-known in the art. A second unit 121 includes a receiver transducer 128 whose output is directed to a detector/alarm 130. A reed switch S is now interposed in-line between the transducer and detector/alarm. The magnet/reed switch arrangement operate in the conventional manner so that as the units 120, 121 move away from each other, the magnetic field attraction on the switch S lessens to where the switch. which is initially closed, now opens. This disrupts the path between receiver tansducer 128 and detector/alarm 130 so optical signals received by the transducer can no longer be received and processed by the detector/alarm. As a result, the detector/alarm will generate an alarm signal. It will be understood that Hall effect devices can be used in place of the reed switch to obtain similar results.

What has been described is a security system and sensing element which overcomes shortcomings of prior art security systems which depend on magnetic fields and their disruption or change to indicate an alarm condition. By using a transmission signal in the range of light, such as the output of a light-emitting-diode in the infra-red range, the system cannot be compromised by a magnet or other unit which produces and/or varies a magnetic field. The security system of the present invention uses a first unit mounted in a relatively fixed position such as a door frame or window frame, and a second unit mounted to the movable element; i.e., the door or window. Coded data is transmitted back and forth between the two active circuits in a restricted transmission path, such that varying the physical proximity of the two circuits interrupts or modifies the transmission path with the system identifying such interruption or modification as an alarm condition. By using a complex algorithm, for example, the type now used by financial institutions to verify communications in funds' transmission, security of the system of the invention is virtually assured. The transmitted data must be appropriate so that, when modified, the correct response is received to indicate proper operation as well as position of the responding unit. The output provided by the microprocessors and code units is a special data set known to the code module in the microprocessor of both units. These data sets are the result of encryption algorithms known to be especially difficult for units, other than these two specific code units, to decode. The movable unit can be powered from a battery internal to the unit, or from energy received over the system conductors which carry information between the various security points and the system controller, or from some other source.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A security system monitoring a relative displacement between a first unit and a second unit which are normally in close proximity to each other but which are movable relative to one another, comprising:

a first code, generator in the first unit for generating a first coded electrical signal corresponding to a first predetermined coded signal;

a first transducer in the first unit to which said first coded electrical signal is supplied by said first code generator, said first transducer being responsive to said first coded electrical signal to convert said first coded electrical signal into a signal transmitted toward said second unit;

a first transducer in the second unit receiving a signal transmitted from said first unit and for converting said received signal back into an electrical signal;

a second code generator in said second unit to, which said an electrical signal from the first trasducer in the second unit is supplied, said second code generator determining if the electrical signal supplied to it corresponds to said first predetermined coded signal and, if so, said second code generator generating a second coded electrical signal corresponding to a second predetermined coded signal;

a second transducer in the second unit to which said second coded electrical is supplied, said second transducer being responsive to said second coded electrical signal to convert said second coded electrical signal into a signal transmitted toward said first unit; and, a second transducer in the first unit receiving a signal transmitted from said second unit and converting said received signal back into an electrical signal, said first code generator determining if the electrical signal supplied to it corresponds to said second predetermined coded signal, failure of said first unit to receive said second predetermined coded signal from said second unit indicating either that said first and second units are no longer in close proximity with each other, or that someone is trying to compromise the security system, either condition being an alarm condition for which an appropriate alarm is produced by said security system.

2. The security system of claim 1 wherein said transducers in said first and second units are light transducers for appropriately converting said coded electrical signals from the respective code generators into light signals transmitted between the units and for converting received light signals into the electrical signals supplied to the respective code generators.

3. The security system of claim 1 wherein said first and second code generators are each microprocessors each of which monitors both the code content of the electrical signal supplied to it by the appropriate transducer and the amplitude of the electrical signal, the microprocessors being responsive to the code content of the electrical signal not corresponding to the coded content of the appropriate predetermined coded signal, or to the amplitude of the electrical not being within a predetermined range of amplitude values to cause the alarm to be produced by the system.

4. The security system of claim 1 wherein said first and second predetermined coded signals are different in content.

5. The security system of claim 3 wherein said microprocessors are each programmed to change said predetermined coded messages so the coded messages sent between units at one time differ from the coded messages sent at another time.

6. The security system of claim 1 wherein each unit includes its own source of power.

7. The security system of claim 1 having a common source of power for the two units.

* * * * *

UNITED STATES PATENT AND TRADEMARK OFFICE

CERTIFICATE OF CORRECTION

PATENT NO. : 5,912,619

DATED : June 15, 1999

INVENTOR(S) : William R. Vogt, Tom W. LeNay and Donald L. Hadden

It is certified that error appears in the above-indentified patent and that said Letters Patent is hereby corrected as shown below:

On the title page, item [75], please add the following:
--Tom W. LeNay, Los Angeles, CA, and Donald L. Hadden, Alberta, Canada--.

Signed and Sealed this

Twenty-third Day of November, 1999

*Attest:*

Q. TODD DICKINSON

*Attesting Officer*

*Acting Commissioner of Patents and Trademarks*